US005666627A

United States Patent [19]

Yamaguchi

[11] Patent Number: 5,666,627

[45] Date of Patent: Sep. 9, 1997

[54] FIXING DEVICE WHICH UTILIZES HEAT GENERATED BY ELECTROMAGNETIC INDUCTION

[75] Inventor: Chiseki Yamaguchi, Tokyo, Japan

[73] Assignee: NEC Corporation, Tokyo, Japan

[21] Appl. No.: 428,342

[22] Filed: Apr. 25, 1995

[30] Foreign Application Priority Data

Apr. 25, 1994 [JP] Japan ..... 6-107417

[51] Int. Cl.[6] ..... G03G 15/20

[52] U.S. Cl. ..... 399/330; 399/335

[58] Field of Search ..... 355/282, 285, 355/289, 290; 219/216; 118/60; 399/320, 328, 330, 335, 338

[56] References Cited

U.S. PATENT DOCUMENTS

| | | | |
|---|---|---|---|
| 4,912,514 | 3/1990 | Mizutani | 219/216 X |
| 5,241,159 | 8/1993 | Chatteriee et al. | 219/216 X |
| 5,278,618 | 1/1994 | Mitani et al. | 355/285 |
| 5,450,183 | 9/1995 | O'Leary | 355/285 |

FOREIGN PATENT DOCUMENTS

| | | |
|---|---|---|
| 0361462 | 4/1990 | European Pat. Off. . |
| 6-73155 | 11/1992 | Japan . |
| 5-9027 | 2/1993 | Japan . |

OTHER PUBLICATIONS

Patent Abstracts of Japan, Abstract of JP–A 61–261763.
Patent Abstracts of Japan, Abstract of JP–A 60–254071.
Patent Abstracts of Japan, Abstract of JP–A 59–197067.
Patent Abstracts of Japan, Abstract of JP–A 57–128373.
Patent Abstracts of Japan, Abstract of JP–A 62–150371.

*Primary Examiner*—Sandra L. Brase
*Attorney, Agent, or Firm*—Sughrue, Mion, Zinn, Macpeak & Seas

[57] ABSTRACT

A fixing device comprises a heat roller constructed from a material which generates heat by eddy currents, an induction heating element which causes the heat roller to generate the eddy currents by electromagnetic induction, and pressing roller for pressing an ink material-applied recording medium against the heat roller. The induction heating element comprises an arc-section insulating support placed adjacent to the surface of the heat roller and a conductive line through which flows a drive current which causes electromagnetic induction resulting in the passage of the eddy currents. The heat roller is excited by the magnetic flux provided by the passage of the drive current through the conductive line of the induction heating element, thereby generating the eddy currents. The eddy currents cause Joule heat which heats the heat roller.

13 Claims, 8 Drawing Sheets

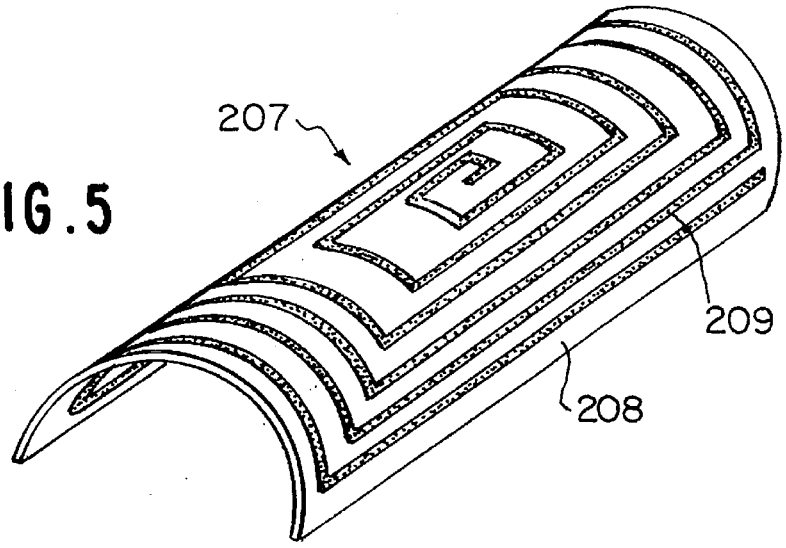
FIG. 5
FIG. 6
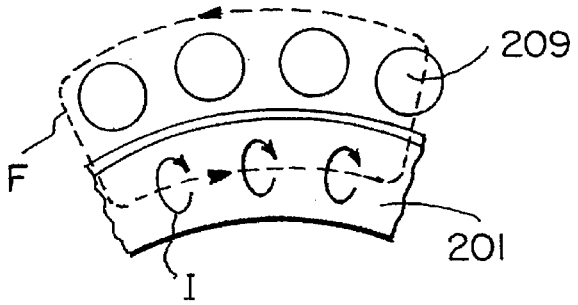
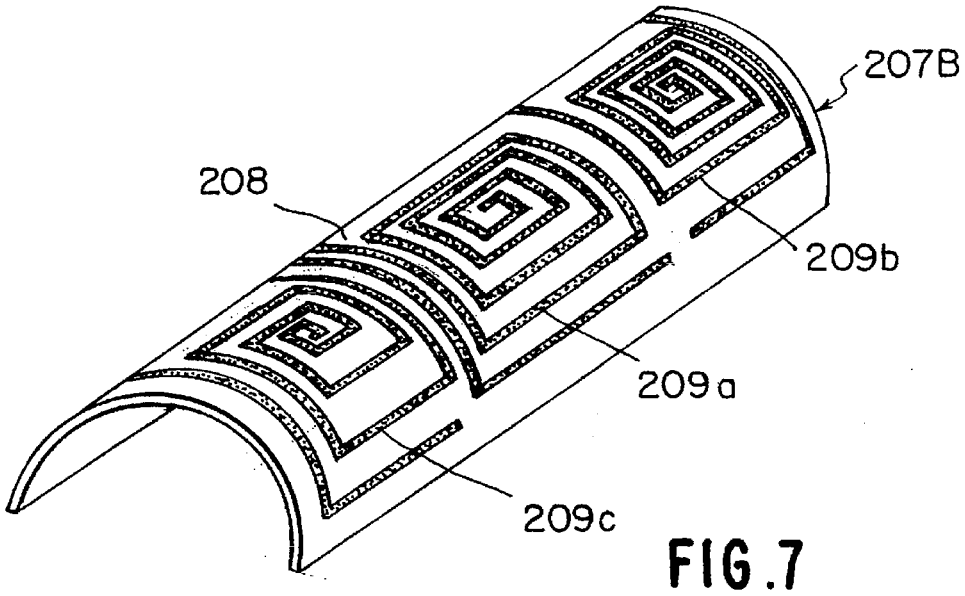
FIG. 7

FIXING DEVICE WHICH UTILIZES HEAT GENERATED BY ELECTROMAGNETIC INDUCTION

BACKGROUND OF THE INVENTION

1. Field of The Invention

The present invention related to a fixing device which is used for electrophotographic image foxing apparatuses to fix an ink material such as toner on a recording medium on which the material has been applied, and particularly to a fixing device for fixing an ink material on a recording medium by heating and pressing.

2. Description of The Prior Art

In most image forming apparatuses based on electrophotography, including copying machines, laser printers, etc., an ink material such as toner is applied to a recording medium directly or by means of a photoconductor, and such apparatuses are equipped with a fixing device for processing the ink material to fix it on the recording medium. A typical conventional fixing device is one which utilizes heat pressure fixation, that is, fixation by heat and pressure.

This heat pressure fixing device is equipped with a heat roller which generates heat and a press roller which contacts with the heat roller under a given pressure. FIG. 1 is a cross sectional view of a representative conventional heat pressure fixing device. In the drawing, the heat roller 301A is constructed from a heat-resistant, thin-walled, cylindrical drum, and an arc-like support guide 312 is placed inside the heat roller 301A along the area of contact between the heat roller 301A and press roller 302. A linear heating element 311 partially lines the inner surface of the arc-like support guide 312 while supported thereon. A paper guide 6 is arranged extending along the feed path for the sheet 2 as a recording medium, and a pair of discharge rollers 305 and 306 are placed downstream from the heat roller 301A and press roller 302 in such a manner that the pair of discharge rollers are pressed against each other. The heat roller 301A is equipped with a cleaning pad 308, a temperature sensor 310 and a release claw 309. The bearing section 303 of the press roller 302 is provided with a press spring 304 which functions as a pressure source.

When the heat roller 301A and press roller 302 are rotated in the direction indicted by the shown arrow, the sheet 2 with ink material to be fixed applied on its surface facing the heat roller 301A moves along the paper guide 6 and passes between the two rollers 301A and 302. Here, the ink material is fixed by being heated by the linear heating element 311 and pressed against the surface of the sheet. The sheet with the fixed ink material is then conveyed by the discharge rollers 305 and 306 and discharged through an outlet (not shown). In addition, the temperature sensor 310 detects the temperature of the heat roller 301A, and controls the amount of current to be fed to the linear heating element 311 as the heating source thereby controlling the heat roller 301A to a given temperature. Further, the cleaning pad 308 is provided to clean the surface of the heat roller 301A, and the release claw 309 is placed to prevent the sheet from wrapping the heat roller 301A. Heating of only portions of the heat roller 301A which come in contact with the linear heating element 311 provides the advantages of increased thermal efficiency and shortened warm-up time.

With this type of fixing device, however, since it is necessary to heat the drum-like heat roller 301A at a low temperature to a given temperature in a short time by the heat generated by the linear heating element 311, the linear heating element 311 must be a high-calorie type which becomes a bar against lowering in power consumption.

Another possible problem is lower heating efficiencies due to direct outward radiation of part of the heat generated by the linear heating element 311 which is expended without heating the heat roller 301A.

In addition, it is required to control the linear heating element 311 to a uniform temperature along its lengthwise direction because of direct influence of variations in temperature of the linear heating element 311 upon the fixation. Thus, there is presented the additional problem of difficult preparation and control of the linear heating element 311 due to required uniformity during the manufacturing process and temperature control with high accuracy during the operation.

Therefore, recently attention has been centered on heat pressure type fixing devices which do not use heating elements such as linear heating elements. This type of fixing device is designed to fix an ink material on a sheet by electromagnetic induction heating, and are disclosed in Japanese Examined Patent Application Publication HEI No. 5-9027 and Japanese Examined Patent Application Publication HEI No. 4-73155. The fixing device described in Japanese Examined Patent Application Publication HEI No. 5-9027 is equipped with a heat roller arranged in a closed magnetic circuit constructed from an excitation core and an auxiliary core, and is designed so that the heat roller is heated by Joule heat which is generated by eddy currents produced by a magnetic flux through the heat roller in its width direction. On the other hand, the fixing device described in Japanese Examined Patent Application Publication HEI No. 4-73155 comprises a closed magnetic circuit which is constructed from a looping magnetic member which surrounds the heat roller. The magnetic member is composed of a laminated core. An excitation coil is rolled around the magnetic member inside the heat roller so that the heat roller in the closed magnetic circuit undergoes induction heating by application of an AC signal to the excitation coil.

The aforementioned electromagnetic induction heating type of fixing device, however, requires placement of coiled laminated cores both inside and outside the heat roller, and this requires to upsize the diameter of the heat roller and eventually the fixing device since the cores themselves are large. An additional drawback is that the cores are heavy. Furthermore, with the fixing device, it is difficult to accomplish local heating of the heat roller; particularly it fails to heat the area of contact between the heat roller and press roller in a concentrated manner.

SUMMARY OF THE INVENTION

It is an object of the present invention to provide an electromagnetic induction heating type of fixing device which has achieved miniaturization and weight reduction.

It is another object of the present invention no provide a fixing device which allows local heating of the surface of heat rollers.

The fixing device according to the present invention comprises a heat roller constructed from a material which generates heat by eddy currents; an induction heating element which causes the heat roller to generate the eddy currents by electromagnetic induction; and a pressing member for pressing an ink material-applied recording medium against the heat roller. The induction heating element comprises an insulating support having a curved surface which curves along the surface of the heat roller and is placed adjacent to the surface; and a conductive line secured to the insulating support along the curved surface. A drive current is supplied to the conductive line to generate magnetic flux resulting in the passage of the eddy currents. The heat roller is excited by the magnetic flux provided by the passage of the drive current through the conductive line of the induction heating element, thereby generating the eddy currents. These eddy currents cause Joule heat which heats the heat roller. The drive current is an AC signal at a frequency ranging from 10 Hz to 50 KHz. The temperature of the heat roller may be controlled by a control circuit which controls the flow of the drive current applied to the conductive line. The induction heating element may be adjacent to either the outer or inner surface of the heat roller. Here, "adjacent" includes both "in contact with" and "spaced slightly"; the state matching the latter definition is preferred. The conductive line may be embedded in the inside of the insulating support or secured to its surface. The conductive line is preferred to be a spiral line for the efficient generation of eddy currents.

The insulating support may be an arc-shaped plate and width on the order of several millimeters according to the present invention, thus making it possible to accomplish miniaturization and weight reduction of fixing devices.

BRIEF DESCRIPTION OF THE DRAWINGS

Other objects, features and advantages of the present invention will become more apparent when the following description is read in conjunction with the accompanying drawings, wherein:

FIG. 5 is a perspective view of an induction heating element which is used for fixing devices of the type shown in FIG. 3;

FIG. 6 is a cross sectional view which shows the principle of electromagnetic induction by the induction heating element shown in FIG. 5;

FIG. 7 is a perspective view which shows another example of the induction heating element shown in FIG. 5;

DETAILED DESCRIPTION OF THE PREFERRED EMBODIMENTS

Figure 1:
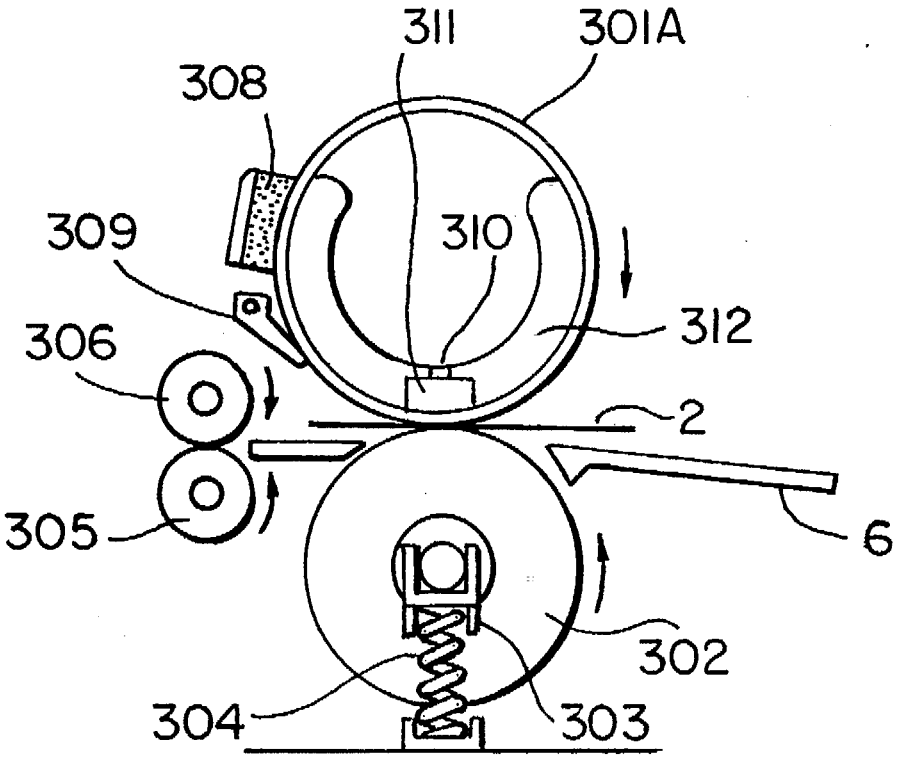
FIG. 1 PRIOR ART
FIG. 1 is a cross sectional view of a representative conventional fixing device.
Figure 2:
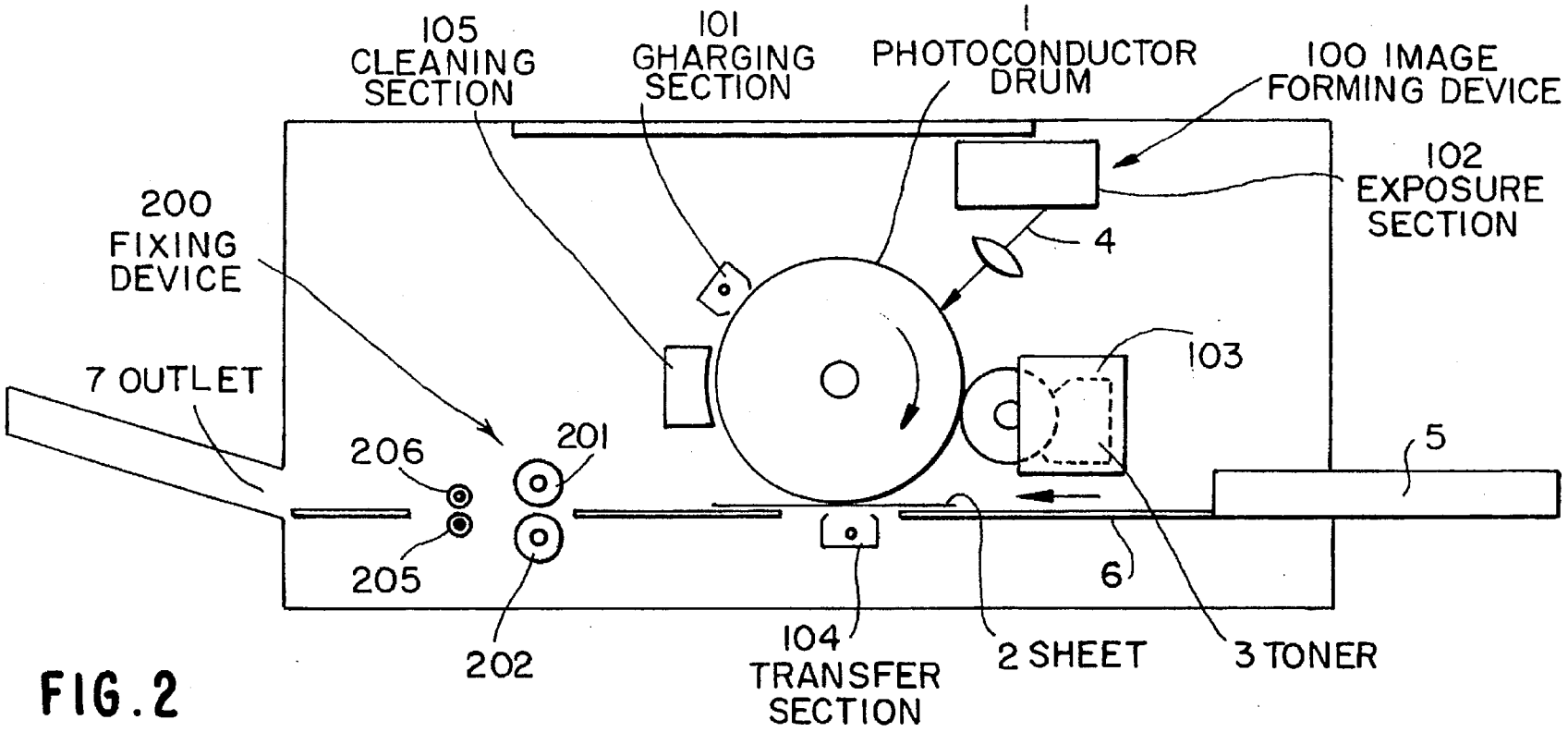
FIG. 2 is a schematic view of a laser printer using the fixing device according a first embodiment of the present invention.

FIG. 2 is a schematic view of a laser printer using the fixing device according to a first embodiment of the present invention. The laser printer shown in the drawing comprises an image forming device 100 consisting mainly of a photoconductor drum 1 and a fixing device 200 which fixes, thermally under pressure, toner, an ink material, applied to the surface of a sheet 2 by the image forming device 100. The image forming device 100 has a charging section 101, an exposure section 102, a development section 103, a transfer section 104 and a cleaning section 105 which are arranged around a photoconductor drum 1. The charging section charges the surface of the photoconductor drum 1. The exposure section 102 scans the surface of the photoconductor drum 1 with laser light 4 for exposure to the light in a given pattern to form a latent image. The development section 103 develops the latent image formed on the surface of the photoconductor drum 1 by applying toner 3 thereto. The transfer section 104 transfers the developed image of the toner 3 to the surface of the sheet 2 which is led from a paper feeding cassette 5 by a paper guide 6. After transferring, the residual toner is removed from the surface of the photoconductor drum 1 by the cleaning section 105. The sheet 2 with the toner 3 attached thereon is conveyed to the fixing device 200.

Figure 3:
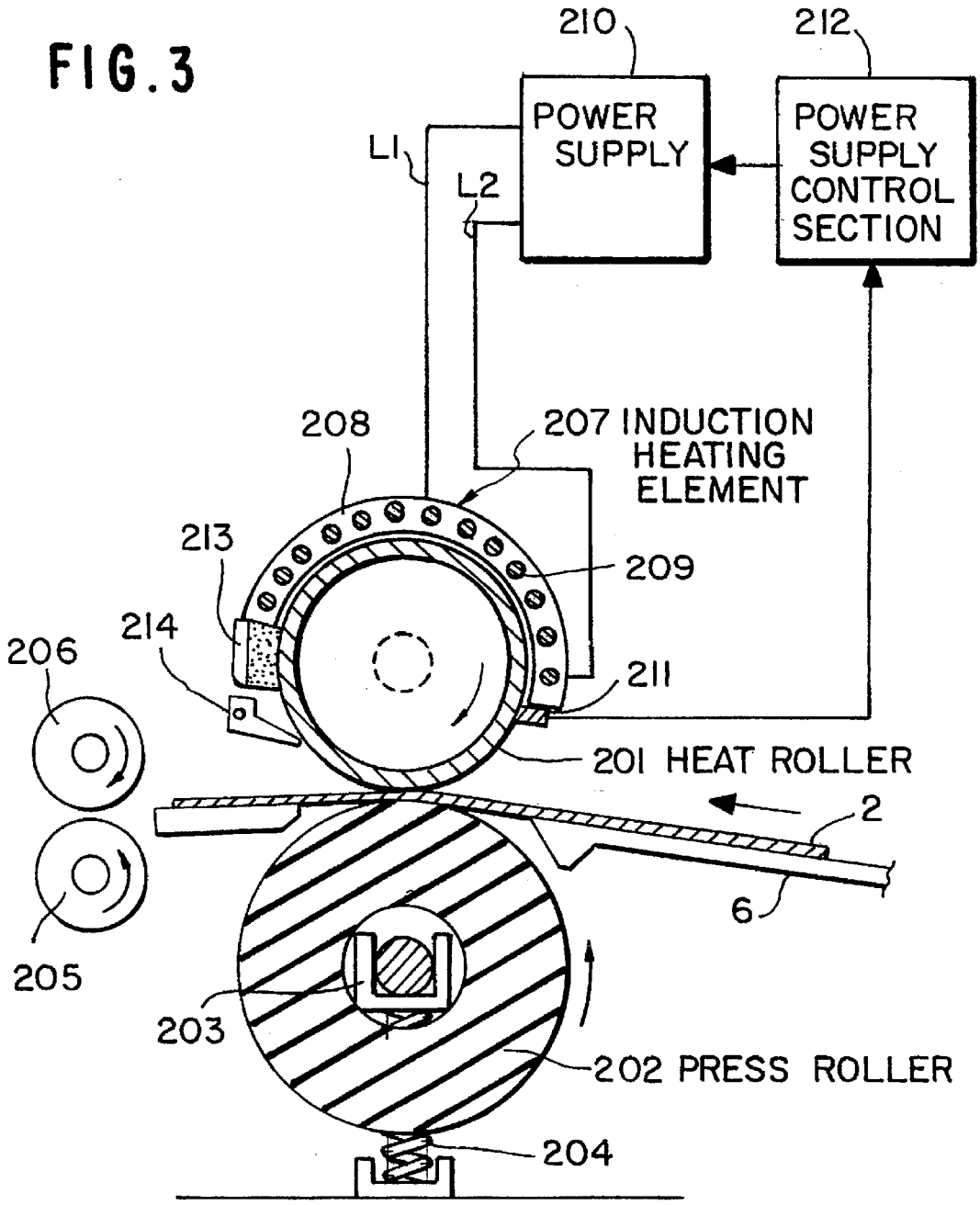
FIG. 3 is a cross sectional view of the fixing device according to the first embodiment of the present invention.
Figure 4:
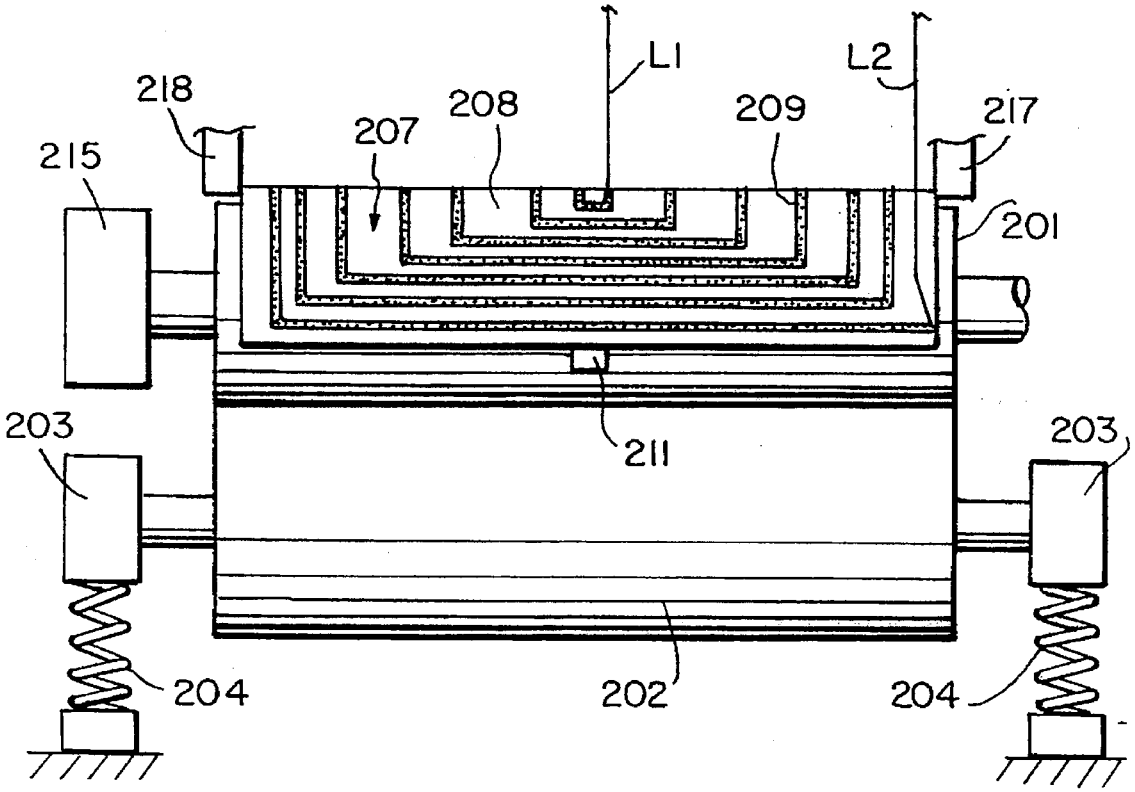
FIG. 4 is a right side view of the fixing device shown in FIG. 3.

As shown in FIG. 3 and FIG. 4, the fixing device 200 comprises a parallel arrangement of a heat roller 201 as the heating member and a press roller 202 which are in contact with each other in their radial direction. The heat roller 201 is driven to rotate in the direction indicated by the arrow shown in FIG. 2 by a rotation drive mechanism 215 (FIG. 4). On the other hand, the press roller 202 is pressed against the surface of the heat roller 201 along their radial direction by press springs 204 provided at each of a pair of bearing sections 203, and is driven to rotate by the rotation of the heat roller 201. Then, the sheet 2 with toner to be fixed applied on its surface is inserted and passed between the two rollers 201 and 202, during which passage the toner is fixed by being heated by the heat roller 201 while being pressed by the press roller 202. This toner-fixed sheet 2 is then sent to an outlet 7 (see FIG. 2) by a pair of discharge rollers 205 and 206 for ejection.

The heat roller 201 may be formed of a metal such as carbon steel, copper, brass, aluminum or the like, and preferably of carbon steel with a high generation efficiency of Joule heat in order to increase the induction heating efficiency which will be described later. An induction heating element 207 is provided along the outer circumference of the heat roller 201 except the area of its contact with the press roller 202. The induction heating element 207 comprises an insulating support 208 which curves along the outer circumference of the heat roller 201 and an induction coil 209 for induction heating of the heat roller 201, disposed under the curved inner surface of the insulating support 208, and the induction heating element 207 is placed in contact with or spaced very slightly from the outer surface, of the heat roller 201. The induction heating element 207 is anchored in the laser printer by means of supporting members 217 and 218 (FIG. 4). In order not to generate eddy currents through the insulating support 208 itself and also not to cause shorting of the induction coil 209, the support 208 is formed of a metalloid material, specifically a ceramic material in the present embodiment. The surface of this insulating support 208 is coated with a fluorine plastic to provide releasability from the ink material toner.

The induction coil 209 is embedded inside the insulating support 208. As shown in FIG. 4, this induction coil 209 comprises a small-diameter conductive wire or film extending along the semi-cylindrical, curved surface of the insulating support 208, in a generally spiral arrangement over the entire width of the insulating support 208. Here, the induction coil 209 is arranged so that spacings between lines of the induction coil 209 decrease toward the two lengthwise ends of the insulating support 208. This induction coil 209 is energized by a power supply 210 for induction heating via lead wires L1 and L2. At first glance of FIG. 5, the induction coil 209 appears to-be formed on the surface of the insulating support 208, but is actually embedded in the insulating support 208 as described above.

An explanation will now be given regarding a method of manufacturing the induction heating element 207. First, a raw ceramic to be baked is placed on a semi-cylindrical mold and shaped as an insulating support and then an induction coil 209 is arranged or printed on its surface. Thereafter, the induction coil 209 is covered with raw ceramic to be embedded therein. Finally, the raw ceramic is baked to complete an induction heating element 207. According to another manufacturing method, an induction-coil 209 may be sandwiched between baked ceramics and secured between them with an insulating adhesive.

As is shown in FIG. 3, the heat roller 201 is equipped with a temperature sensor 211 for detecting the temperature of the heat roller 201. The temperature sensor 211 is located in a portion of the circumference of the heat roller 201, more specifically, at a position downstream from the heat roller 201 of the induction heating element 207 in the direction of its rotation. Outputs of detection by the temperature sensor 211 are fed to a power supply control circuit 212. The power supply control circuit 212 controls the power supply 210 so that the power to be fed to the induction coil 209 is varied on the basis of the temperature of the heat roller 201. That is, the power supply control section 212 controls the temperature to a certain degree by decreasing the power when the temperature of the heat roller is higher and increasing the power when its temperature is lower.

Furthermore, a cleaning pad 213 is placed downstream from the heat roller 201 in the direction of its rotation, in contact with the surface of the heat roller 201 for its cleaning, and placed adjacent to the pad 213 is a release claw 214 the tip of which is in slight contact with the surface of the heat roller 201.

In FIG. 3 and FIG. 4, when the heat roller 201 is rotated in the direction of the arrow shown in FIG. 3 by the rotation drive mechanism 215, the press roller 202 pressed against it by the press spring 204 is driven to rotate by the roller 201. The temperature sensor 211 detects the surface temperature of the heat roller 201 and an output of the sensor is supplied to the power supply,control circuit 212. When the power supply control circuit 212 finds out that the detected temperature is lower than a given temperature, an alternating current is supplied to the induction coil 209 from the power supply 210 for induction heating. The frequency of the alternating current ranges from 100 Hz to 50 KHz, and preferably is 1–10 KHz. This alternating current produces an alternating flux F across the induction coil 209 and heat roller 201, as shown in FIG. 5. The alternating flux F excites the heat roller 201 to generate eddy currents I through the heat roller 201. Generation of the eddy currents I through the heat roller 201 causes production of Joule heat which heats the heat-roller 201. This means that the temperature of the heat roller 201 is increased by electromagnetic induction heating.

The temperature of the heat roller 201 is increased by the induction heating element 207 during rotation of the heat roller 201. When the temperature sensor 211 finds out that the surface temperature of the heat roller 201 is increased to a given temperature, the power supply control circuit 212 controls the output of the power supply 210 for induction heating so as to maintain the surface of the heat roller 201 at the given temperature.

Then, as the heat roller 201 further rotates, the surface of the heat roller 201 is cleaned by the cleaning pad 213 and then heated again for use in the next fixation.

When the sheet 2 has passed the area of contact between the heat roller 201 and press roller 202 and moved toward the cleaning pad 213 along the heat roller 201, the sheet is separated from the heat roller 201 by the release claw 214 and moves toward the discharge rollers 205 and 206.

As mentioned above, since the fixing device 200 is designed so that the heat roller 201 generates heat by electromagnetic induction heating, only a minimum amount of heat is directly radiated outside the induction heating element 207, and therefore most of the power supplied to the induction coil 209 is utilized to increase the temperature of the heat roller 201 for increased heating efficiency. In addition, the heat by the induction heating is generated only in the outernal surface of the heat roller 201, and the outernal surface which is in contact with the sheet 2 allows speedy increase in temperature and thus shortening of the warm-up time. Furthermore, since the heat is generated in a region immediately upstream from the area where the sheet 2 is heated, the generated heat may be utilized effectively to heat the sheet; the heat may be used at increased efficiencies in this way. Furthermore, since the induction heating element 207 may be formed with a thickness on the order of several millimeters, and no cores are used, its miniaturization and weight reduction may be achieved.

Additionally, since the induction coil 209 is arranged so that the spacings between the lines of the induction coil 209 decrease toward the two lengthwise ends of the insulating support 208, temperature at the two lengthwise ends of the surface of the heat roller 201 is higher than at the central section. This design prevents greater decrease in temperature at the two ends of the surface of the heat roller 201 than at its central section due to radiation of heat through the two ends, and thus a uniform temperature may be established throughout to accomplish even and stable fixation.

Different from the conventional linear heating elements, the heating element according to the present invention does not require the temperature control for the respective heating elements arranged along the lengthwise direction and may be free from the problem of difficult manufacturing and control.

Furthermore, since no heating element is located inside the heat roller 201, not only may the job of assembling the heat roller 201 be simplified, but the heat roller 201 may also be constructed with a small-diameter, thus allowing downsizing of the fixing device 200 and laser printers containing it.

The induction coil 209 of the induction heating element 207 is not required to be embedded in the ceramic insulator 208; it may be formed on the surface of the insulating support 208 which is opposite the heat roller 201. In this case, the induction coil 209 may be covered with an adhesive, resin or the like to secure the induction coil 209. The induction coil 209 may be provided with coil groups separately for a plurality of regions of the insulating support 208. For example, in the case of the induction heating element 207B shown in FIG. 6, induction coils **209*a* through 209*c* are separately formed on the central section and the two end sections of the surface of the insulating support 208, and power is selectively supplied to the respective coils 209*a* through 209*c*. With this construction, in cases where a small-width sheet is used as the sheet 2 (FIG. 3), for example, fixation is accomplished successfully by heating only the central section of the heat roller 201 by the current passing through the associated central heating coil 209*a*, without wasting power due to heating of the two end sections of the heat roller 201**.

Figure 8:
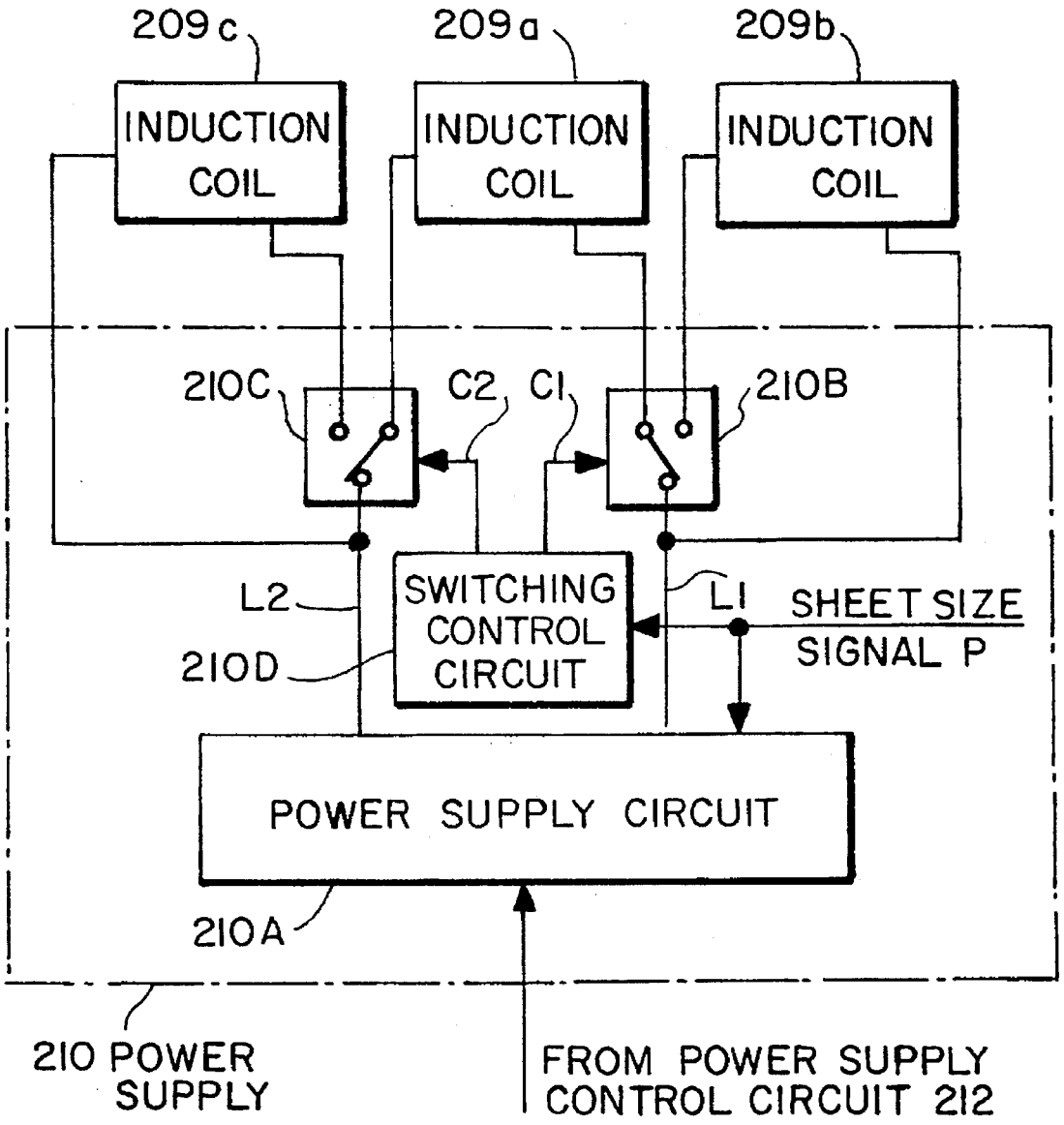
FIG. 8 is a circuit diagram which shows a power supply for induction heating which drives the induction heating element shown in FIG. 7.

FIG. 8 is a circuit diagram of the power supply 210 for induction heating and induction coils in cases where the induction heating element 207B shown in FIG. 7 is used. In FIG. 8, the power supply 210 for induction heating is provided with a power supply circuit 210A for feeding AC power only to the induction coil 209*a*, or to all the induction coils, switches 210B and 210C, and a switching control circuit 210D which controls switching between the switches 210B and 210C. The switches 210B and 210C connect the induction coil 209*a* to the output lines L1 and L2 of the power supply circuit 210A or to the induction coils 210*b* and 210*c*. This connection establishes selective connection of the output lines L1 and L2 to either induction coil 209*a* or a series circuit consisting of induction coils 209*a* through 209*c*. The switching control circuit 210D generates control signals C1 and C2 for switching between the switches 210B and 210C, in response to a sheet size signal P indicating the sheet size.

More concretely, in cases where the sheet size is indicated to be small, the switching control circuit 210D controls the switches 210B and 210C so that the induction coil 209*a* should be directly connected to the output lines L1 and L2, and as a result only the induction coil 209*a* receives power via the power supply circuit 210A. This power is naturally lower than the power to be fed to drive all the induction coils. Power may be saved in this manner. On the other hand, in cases where the sheet size is indicated to be large, the switching control circuit 210D controls the switches 210B and 210C so that the series circuit consisting of the induction coils 209*a* through 209*c* should be connected to the output lines L1 and L2, and as the result all the induction coils receive power via the power supply circuit 210A.

In this way, the level of power to be supplied power supply circuit 210A is varied on the basis of the sheet size signal P, that is, the power supply circuit 210A reduces the power of the drive signal in accordance with a reduction of the size.

The power supplied from the power supply circuit 210A is controlled by the output of the power supply control circuit 212, and the power varies depending on outputs from the temperature sensor 211 shown in FIG. 3.

The use of the power supply 210 for induction heating is not restricted to the circuit of FIG. 8. For example, plurality of power supply circuits may be provided separately for supplying power to the respective induction coils 209*a* to 209*c*, and the power supply circuit to be energized may be selected in response to the sheet size signal P.

Figure 9:
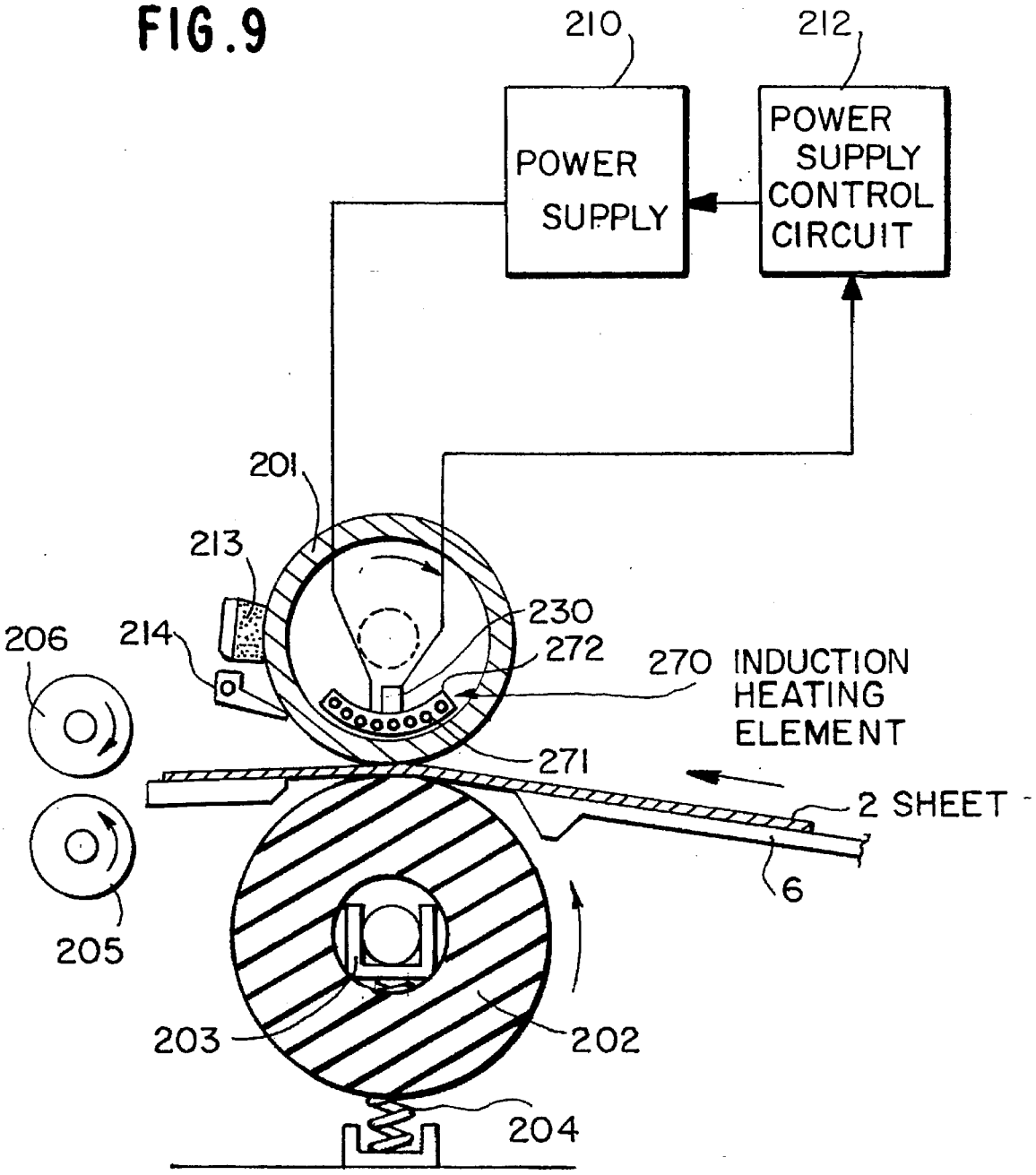
FIG. 9 is a cross sectional view of the fixing device according to a second embodiment of the present invention.
Figure 10:
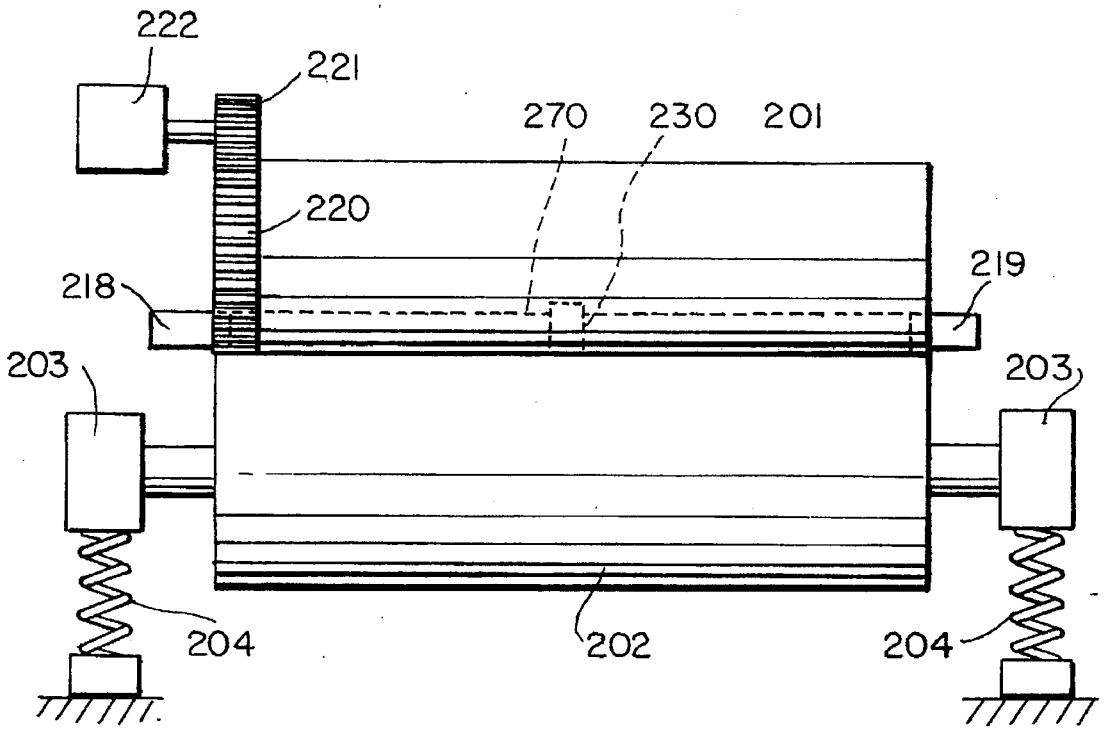
FIG. 10 is a right side view of the fixing device shown in FIG. 9.

FIG. 9 is a cross sectional view which shows the fixing device according to a second embodiment of the present invention, and FIG. 10 is a front view thereof. This embodiment differs from the one shown in FIG. 3 and FIG. 4 with respect to the position of each of the induction heating element 270 and temperature sensor 221. Components other than the induction coils are constructed in almost the same manner as the corresponding components in the preceding embodiment.

The induction heating element 270 is placed in the heat roller 201 and located near the area of contact between the heat roller 201 and press roller 202. The curved surface of the insulating support 272 of the induction heating element 270 faces the inner surface of the heat roller 201 with a slight space or contacts therewith. As shown in FIG. 10, the two ends of the induction heating element 270 in the direction of the axis of the heat roller 201 are secured to the laser printer of FIG. 2 via support members 218 and 219. The temperature sensor 230 extends through the induction heating element 270 to the vicinity of the heat roller 201 to detect its temperature. Lead wires connected with the induction coil 271 and temperature sensor 230, respectively, are drawn out through the end faces of the heat roller 201 and connected to the power supply 210 for induction heating and power supply control circuit 212.

In FIG. 10, a screw section 220 is formed at one end on the circumference of the heat roller 201. This screw section is connected to a rotation drive source 222 via a gear 221. Even if the heat roller 201 rotates, the induction heating element 270 does not rotate.

In the second embodiment, since the induction heating element 270 is located adjacent to the fixing section, eddy currents are generated near the fixing section of the heat roller 201. Accordingly, Joule heat produced by the eddy currents are directly fed to the fixing section to establish high accuracy control of the fixing temperature.

The frequency of the alternating current to be applied to the induction coil 271 may range from 100 Hz to 50 KHz, and is set to the lowest possible level within this range. This is because, if the frequency is higher, only the inner surface of the heat roller 201 is heated and thus, the heat does not conduct to the contact area between the heat roller 201 and press roller 202.

The present invention is not restricted to the embodiments explained above and embraces all possible changes and modifications of the respective requisite constituents enumerated in the appended claims. For example, the induction coils of the induction heating element may be wires or conductive films. In addition, although the cross section of the induction heating element is shaped as an arc according to the second embodiment, circle-section cylindrical induction heating element may also be used. Furthermore, the temperature sensor may be located inside the press roller to detect the temperature near the fixing section. The heat roller may be formed of any material which is heated by the eddy currents.

In the first and second embodiments, a power supply for induction heating is used as the drive circuit for generating a signal which triggers electromagnetic induction. The drive circuit, however, is not required to be a separate power supply circuit and may be a drive circuit which generates AC signals by means of power fed from another power supply circuit. Here, the power fed from another power circuit may be either direct or alternating.

What is claimed:

1. A fixing device for fixing an ink material on a recording medium by heating and pressing the recording material with said ink material applied thereon, which comprises:

a heat roller constructed from a material which generates heat by eddy currents;

an induction heating element which causes said heat roller to generate said eddy currents in said heat roller by electromagnetic induction; and pressing means for pressing said recording medium against said heat roller, wherein said induction heating element comprises:

an insulating support having a curved surface which curves in accordance with a shape of said heating roller and faces closely to a surface of said heating roller; and a spiral conductive line which is secured to an entire area of said curved surface of said insulating support in a generally spiral arrangement over an entire width of said insulating support, said conductive line being provided with a current which causes said electromagnetic induction.

2. The fixing device as claimed in claim 1, wherein said curved surface of said insulating support faces to an outer surface of said heat roller.

3. The fixing device as claimed in claim 1, wherein said curved-surface of said insulting support faces to an inner surface of said heat roller.

4. The fixing device as claimed in claim 3, wherein said induction heating element is placed near a contact area between said heat roller and said pressing means.

5. The fixing device as claimed in claim 1, wherein said conductive line is embedded in said insulating support.

6. The fixing device as claimed in claim 1, wherein said spiral conductive line is arranged so that spacings between respective lines of said spiral conductive line decrease toward the two lengthwise ends of said insulating support.

7. The fixing device as claimed in claim 1, wherein said insulating support is an arc-section insulating plate.

8. A fixing device for fixing an ink material on a recording medium by heating and pressing the recording material with said ink material applied thereon, which comprises:

a heat roller constructed from a material which generates heat by eddy currents;

an induction heating element which causes said heat roller to generate said eddy currents in said heat roller by electromagnetic induction;

a drive circuit for feeding a drive signal to said induction heating element to generate said electromagnetic induction; and pressing means for pressing said recording medium against said heat roller, wherein said induction heating element comprises:

an insulating support having a curved surface which curves in accordance with a shape of said heating roller and faces closely to a surface of said heating roller; and a spiral conductive line which is secured to an entire area of said curved surface of said insulating support in a generally spiral arrangement over an entire width of said insulating support, said conductive line being provided with a current which causes said electromagnetic induction.

9. The fixing device as claimed in claim 8, wherein said conductive line comprises a plurality of conductive line groups which are arrange along the lengthwise direction of said insulating support and are independent from each other, and said drive circuit supplies said drive signal to said conductive line group selected depending on a size of said recording medium.

10. The fixing device as claimed in claim 9, wherein said drive circuit comprises select means for selecting said conductive line group in accordance with the size of said recording medium, and supply means for supplying said drive signal to the selected conductive line group.

11. The fixing device as claimed in claim 10, wherein said supply means reduces a power of said drive signal in accordance with a reduction of the size of said recording medium.

12. The fixing device as claimed in claim 8, which further comprises:

a temperature sensor for detecting the temperature of said heat roller heated by said eddy currents; and a control circuit which controls the strength of said signal from said drive circuit, depending on the output of detection by said temperature sensor.

13. The fixing device as claimed in claim 8, wherein said drive signal is an alternating current whose frequency is ranged between 100 Hz and 50 KHz.

* * * * *